United States Patent [19]

Jones

[11] Patent Number: 4,574,662

[45] Date of Patent: Mar. 11, 1986

[54] DEVICE FOR REMOVING A CORK OR OTHER RESILIENT STOPPER FROM THE NECK OF A BOTTLE

[75] Inventor: Marvin R. Jones, 414 Flintdale, Houston, Tex. 77024

[73] Assignee: Marvin R. Jones, Houston, Tex.

[21] Appl. No.: 696,757

[22] Filed: Jan. 31, 1985

[51] Int. Cl.[4] ..... B67B 7/02

[52] U.S. Cl. ..... 81/3.45; 81/3.48

[58] Field of Search ..... 81/3.07, 3.4, 3.43, 81/3.45, 3.48, 3.47

[56] References Cited

U.S. PATENT DOCUMENTS

| | | | |
|---|---|---|---|
| 1,094,997 | 4/1914 | Jacquemin | 81/3.48 |
| 2,093,541 | 9/1937 | Bohler | 81/3.4 |
| 3,359,838 | 12/1967 | Vogel | 81/3.48 |

FOREIGN PATENT DOCUMENTS

| | | | |
|---|---|---|---|
| 1525876 | 9/1978 | United Kingdom | 81/3.48 |

*Primary Examiner*—Roscoe V. Parker

*Attorney, Agent, or Firm*—Vaden, Eickenroht, Thompson & Jamison

[57] ABSTRACT

There are disclosed several embodiments of a device for use in removing a cork or other resilient stopper from the neck of a bottle, wherein each such device comprises helical spring including at least one helical spring adapted to fit closely within the bottle neck and having a handle at one end by which the spring may be rotated in one directional sense, as it is inserted and forced axially inwardly between the cork and neck, and then pulled axially outwardly so as to remove the cork and spring from the neck.

8 Claims, 14 Drawing Figures

DEVICE FOR REMOVING A CORK OR OTHER RESILIENT STOPPER FROM THE NECK OF A BOTTLE

This invention relates to an improved device for use in removing a cork or other resilient stopper from the neck of a bottle.

The common corkscrew does not always enable the user to apply sufficient force to overcome the friction between the cork and the bottle. Although more sophisticated versions permit the user to apply greater force, through levers and secondary screws, they, like the common corkscrew, damage the cork. As a result, the cork may not be reusable, and the contents of the bottle may be contaminated by fragments of the cork. Still further, these more sophisticated versions, in addition to being much more expensive than the common corkscrew, are of complex construction which is difficult and dangerous to use.

Another device of this type comprises a handle and tines which have a flexible connection to the handle to permit them to be inserted between the opposite sides of the cork and the neck of the bottle by a "walking" motion. Following insertion of the tines, the user rotates the cork which exerting a pull thereon sufficient to remove it from the bottle neck. Although this device does not normally damage the cork, it nevertheless requires the exercise of skill and effort beyond that of many users.

It is therefore an object of this invention to provide a device of this type which is not susceptible to these and other shortcomings in that it does not damage the cork, or cause the contents of the bottle to be contaminated, is relatively inexpensive to manufacture, and is not dangerous or difficult to use.

These and other objects are accomplished, in accordance with the illustrated embodiments of the invention, by a device of the type described comprising helical spring means including at least one helical spring adapted to fit closely within the bottle neck and having a handle at one end by which the spring means may be rotated in one directional sense as it is inserted and forced axially inwardly between the cork and neck. When a sufficiently large surface area of the cork has thus been removed from frictional engagement with the neck of the bottle, the cork begins to turn with the spring means so as to permit the handle to be pulled axially outwardly in order to remove the cork and spring means from the neck. As the handle and thus the spring means are pulled axially outwardly, the spring means will lengthen and thus contract radially about the cork and thereby facilitate its removal from the neck of the bottle. The cork is removable from the spring means upon rotation of the handle in the opposite directional sense with respect to the cork. Since the spring means does not penetrate the cork, the cork is not damaged so that it may be reused, and parts of it are not broken off to contaminate the contents of the bottle.

In one embodiment of the invention, the helical spring means consists of a single helical spring, while in the other embodiments of the inventions, the helical spring means comprises two or more helical coils each wound in the same helical direction. Preferably, the free end of each helical spring is beveled to provide a thin edge adjacent its outer diameter which facilitates its insertion between the cork and neck.

It is also preferred that the handle have a shoulder which may engage with the bottle to limit further insertion of the helical spring means before the cork is free to turn within the bottle neck. Due to the relatively small rotational effect of the helical spring means on the cork, relative to its axial effect thereon, continued rotation of the handle will start to withdraw the cork from the bottle neck and upwardly within a space within the spring means above it. As a result of the continuing lessening of the frictional contact of the cork with the bottle neck, it will become free to rotate with the spring means and so permit remainder of the cork within the neck to be withdrawn. Thus, in its preferred form, the device contemplates a lesser length of helical spring means than would otherwise be required, although, regardless of the length of the spring means, the user may, prior to full insertion of the helical spring means, duplicate the mechanical force due to its screw effect by holding the handle against axial movement while continuing to rotate it.

In certain embodiments of the invention, the handle comprises an extension of one end of each helical spring of the spring means which is bent outwardly and then inwardly across and spaced from such one end. When the spring means includes a pair of helical springs, the extensions of the springs are bent in identical directions and are disposed adjacent to but diametrically opposite to one another across the ends of the helical springs. In other embodiments of the invention, the handle comprises a laterally extending hand piece which is anchored to and encloses the spring means adjacent its one end.

In the drawings, wherein like reference characters are used throughout to designate like parts:

Figure 5:
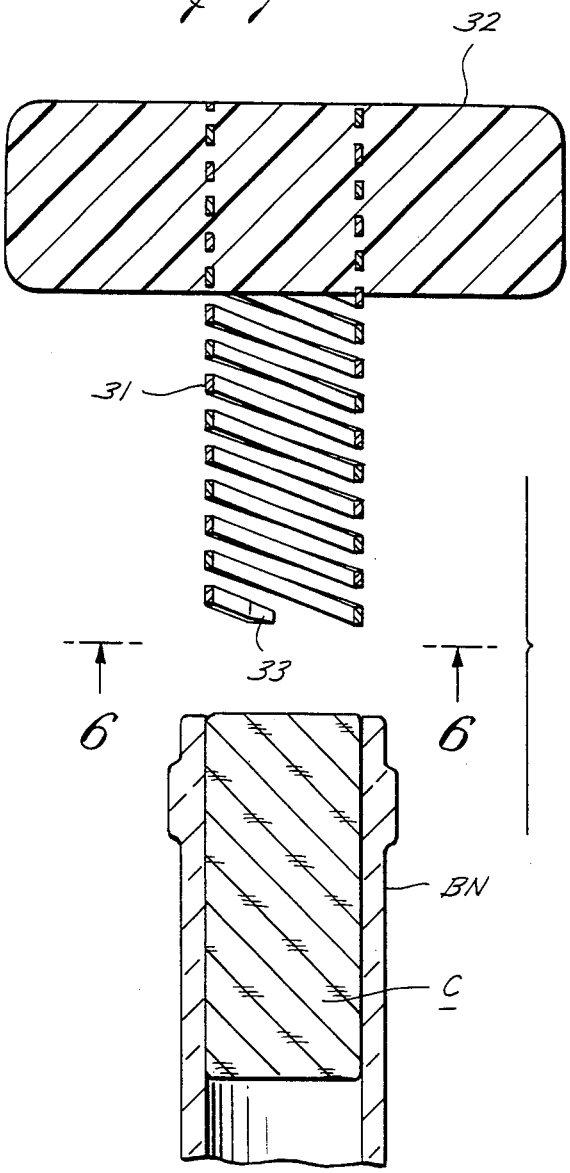
FIG. 5 is longitudinal sectional view of a device constructed in accordance with another embodiment of present invention and comprising three helical springs of somewhat greater length and a laterally extending handle which is anchored to and encloses the springs adjacent one end, the other free ends of the springs being disposed in position for insertion between a cork and neck of a bottle.
Figure 7:
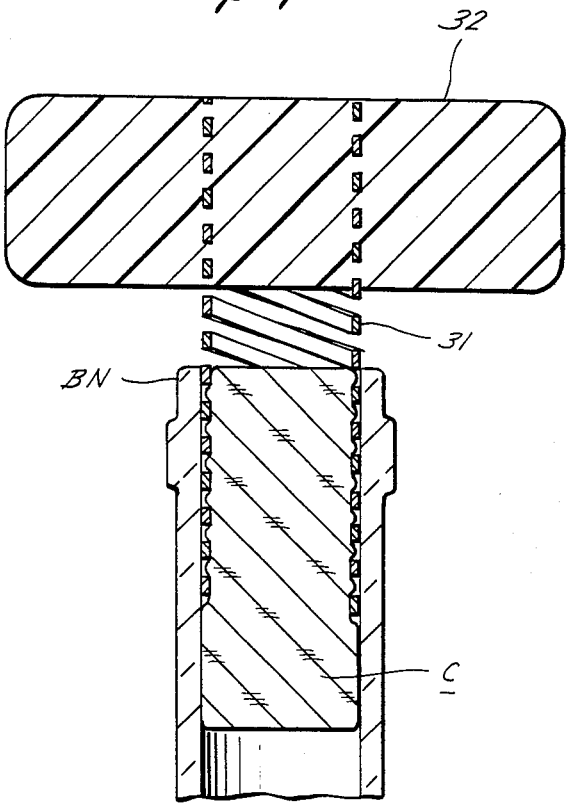
Figure 8:
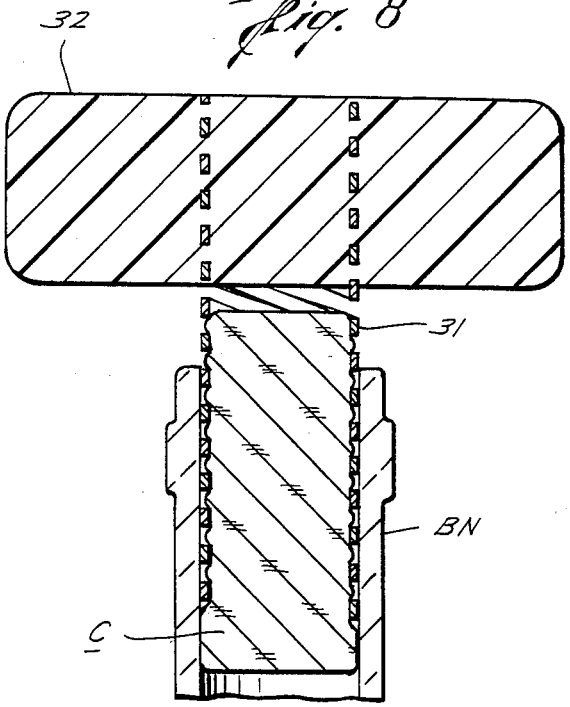
Figure 6:
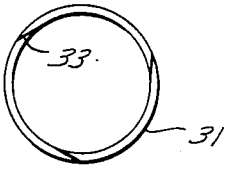
Figure 10:
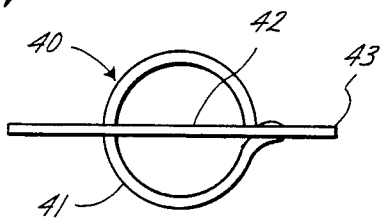
Figure 13:
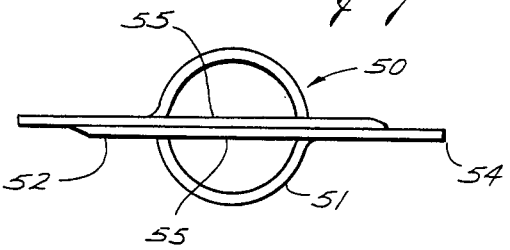
Figure 9:
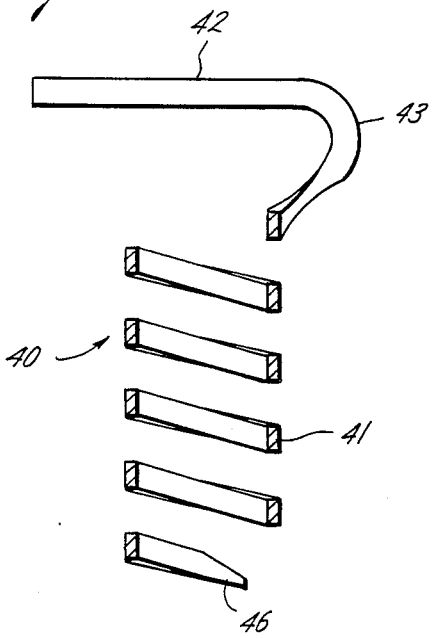
Figure 12:
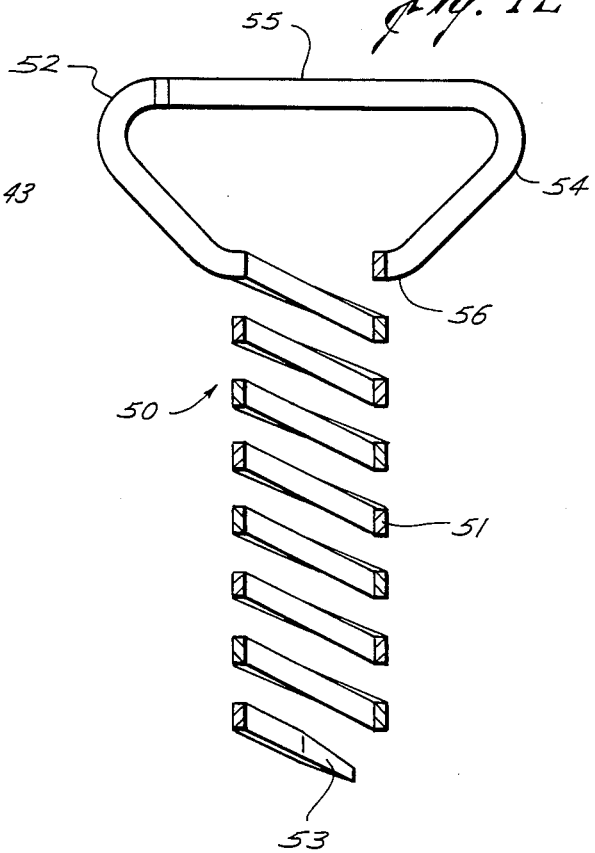
Figure 11:
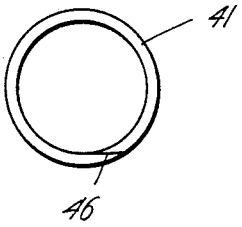
Figure 14:
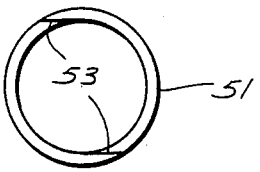

FIG. 6 a lower end view of the helical springs of the device of FIG. 5, as seen along broken lines 6—6 of FIG. 5;

FIG. 7 is another longitudinal sectional view of the device, similar to FIG. 5, but upon insertion of a portion of the helical springs between the cork and bottle;

FIG. 8 still another longitudinal sectional view of the device of FIGS. 5 and 7, but upon continued rotation of the helical springs with the handle, while the handle is held against longitudinal movement with respect to the bottle neck, to cause the upper end of the cork to move out of the end of the neck of the bottle and into a space within the helical coil springs beneath the handle;

FIG. 9 a longitudinal sectional view of a device constructed in accordance with still another embodiment of the present invention, and comprising a single helical spring and a handle formed by an extension of the end of the helical spring;

FIG. 10 is a view of the upper end of the device of FIG. 9, and showing the extension of the helical coil which forms the handle including a portion bent across the upper end of the spring;

FIG. 11 is a lower end view of the device of FIG. 9;

FIG. 12 is a longitudinal sectional view of a device constructed in accordance with yet a further embodiment of the present invention, and comprising a pair of helical springs and a handle formed by extensions of both springs;

FIG. 13 is a view of the upper end of the device of FIG. 12, and showing the disposal of the bent portions of the extensions of the springs adjacent one another to form a hand piece across the end of the springs; and FIG. 14 is a view of the lower end of the device of FIG. 12.

With reference now to the details of the above described drawings, the device which is shown in FIGS. 1 to 4, and illustrated in its entirety by reference character 20, comprises a pair of helical springs each wound in the same helical direction, and a laterally extending handle 22 at one end of the springs which enables the springs to be rotated in one directional sense as they are forced axially inwardly between a cork C and a bottle neck BN in which the cork C is tightly fitted. More particularly, and as previously mentioned, the handle also enables the helical springs to be pulled axially outwardly with respect to the bottle neck, so that, when the cork begins to turn with the helical springs, the cork and the helical springs may be removed from the bottle neck. Then, of course, upon removal from the bottle neck, the cork may be removed from the helical springs upon rotation of the handle in the opposite directional sense with respect to the cork— as, for example, by holding each in one hand—whereby the device is ready for use in again removing a cork from a bottle neck, and the cork is in condition for reuse by being fitted back into the bottle neck.

As shown, the helical coils are wound in the same direction, of the same lead and pitch so that their free ends enter the bottle neck at the same time, but 180° out of phase so that their adjacent convolutions are equally spaced from one another. In order to facilitate insertion of the helical springs between the cork and the bottle neck, the free end of each spring is beveled at 24 to provide a thin edge adjacent its outer diameter. The lower ends of the spring at the same longitudinal level so that both will begin to move between the upper end of the cork and upper end of the bottle neck at substantially the same time.

Figure 1:
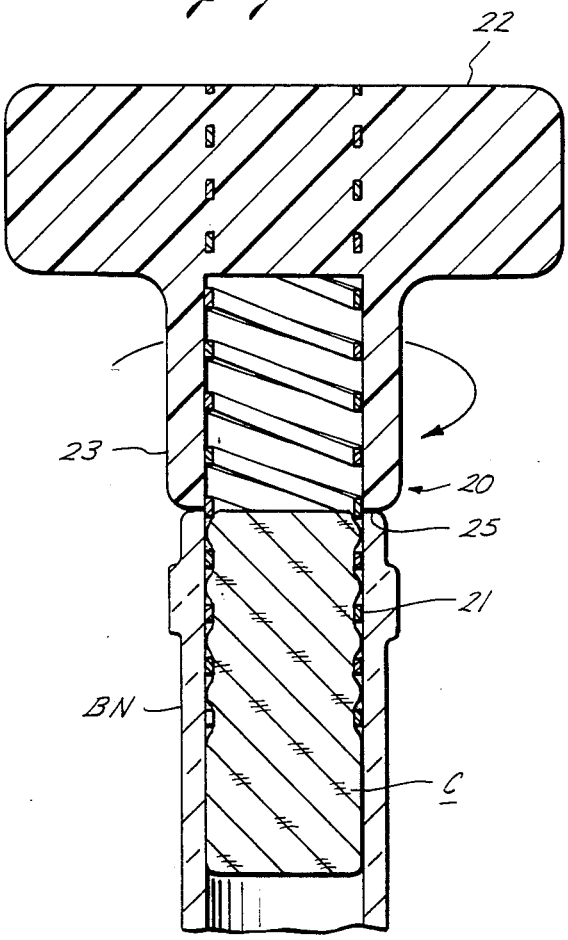
FIG. 1 is a longitudinal sectional view of a device constructed in accordance with one embodiment of the present invention, and showing both of its helical springs inserted between the cork and bottle neck to a position in which a shoulder on its handle has engaged with the end of the bottle neck.
Figure 2:
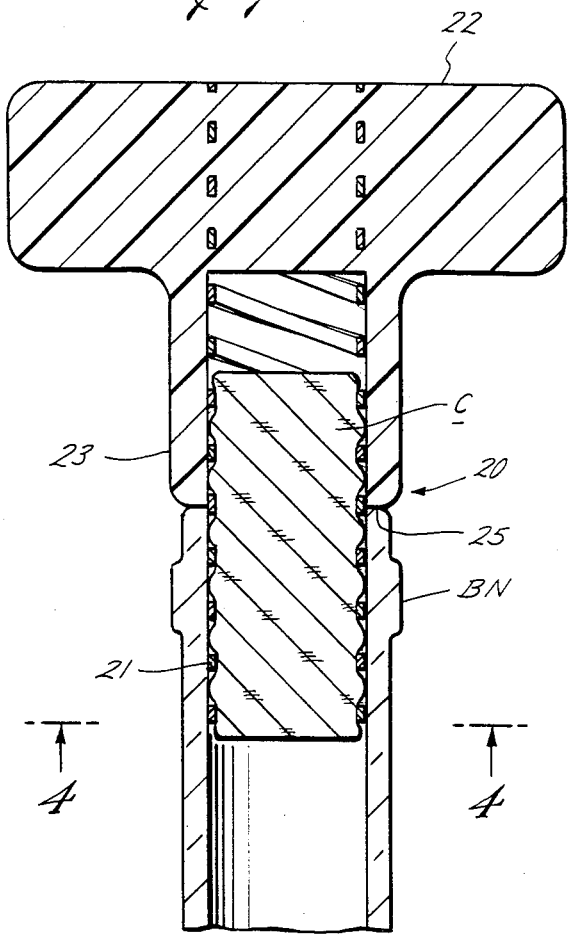
FIG. 2 is another vertical sectional view of the device, similar to FIG. 1, but showing how continued rotation of the handle in one directional sense causes the cork to be raised partially out of the bottle neck and into a space thereabove.

The handle 22 comprises a plastic body which is round or elongate at its upper end in which the upper ends of the helical springs are embedded. A tubular extension 23 of the body fits closely about a mid portion of the helical springs to form a space into which the upper end of the cork may be drawn, as shown in FIG. 2 and as will be described to follow. As shown in FIG. 1, the lower portions of the helical springs are adapted to fit closely within the neck of the bottle so that they may be inserted between the cork and the bottle neck as the handle is moved axially toward and rotated with respect to the bottle neck in one directional sense (clockwise as seen looking down in FIG. 1).

Upon insertion of the lower portion of the helical coils between the cork and the bottle neck to the position of FIG. 1, a shoulder 25 on the lower end of the tubular extension 23 of the handle engages the upper end of the bottle neck. As a result, upon continued rotation of the handle and thus the helical springs in the directional sense, the cork will be caused to move axially upwardly into the space within the springs above the cork, as shown in FIG. 2.

As previously described, the reduction in friction between the cork and the bottle neck, due to the replacement of high frictional forces between the cork and the bottle neck with relatively low frictional forces between the helical springs and the bottle neck, and then partial withdrawal of the cork from the bottle neck, will free the cork to rotate with the spring means. At this time, the user may apply an axially outward force on the handle, which, together with the radially inward squeeze of the helical springs on the cork, due to an increase in pitch between the convolutions of the helical coil, will permit the cork to be pulled free of the bottle neck along with the helical springs.

Figure 3:
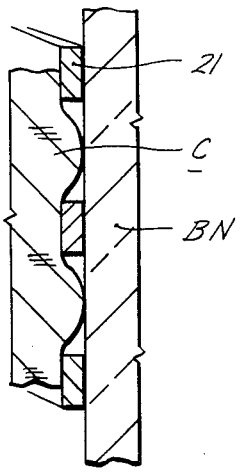
FIG. 3 is an enlarged sectional view of one portion of the helical springs inserted between the cork and the bottle neck.
Figure 4:
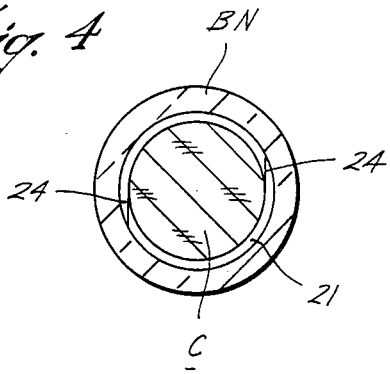
FIG. 4 is a cross-sectional view of the cork and bottle neck, and the helical springs therebetween, as seen along broken lines 4—4 of FIG. 2.

As shown in FIG. 3, the insertion of the helical springs between the cork and bottle neck reduces the frictional engagement between the cork and the bottle neck not only due to the extent of the area of the cork replaced by the springs, but also by other substantial areas of the outer surface of the cork adjacent the springs which are pulled from the bottle neck at locations adjacent the upper and lower edges of each helical spring.

Although this invention contemplates that the device 20 of FIGS. 1 to 4 may have only a single helical spring, and in fact in one embodiment of the invention to be described the spring means consists of only one such helical spring, the use of multiple springs permits using larger leads than would be practical with a single spring. Use of larger leads reduces the number of turns needed to insert the springs, at least in comparison with a single helical spring having the same effective pitch as the two or more helical springs. At the same time, the resulting increase in the helical angle of the helical springs will result in a greater radial contraction of the helical springs, and thus a greater squeeze on the cork, for an axial pull of a given force.

The embodiment of the device illustrated in FIGS. 5 to 8, and indicated in its entirety by reference character 30, comprises three identical helical springs 31 arranged coaxially of one another and 120° out of phase, so that adjacent convolutions are of the same pitch, and a handle 32 anchored at one end of the helical springs. In this embodiment of the device, the handle merely comprises a laterally extending body in which the ends of the helical springs are embedded. That is, as compared with the handle 22 of the device 20, the body of the handle 32 does not have a lower extension in which intermediate portions of the helical springs are received. On the other hand, it has a greater length of helical springs for insertion between the cork C and bottle neck BN.

As in the case of the device 20, the helical springs 31 of the device 30 are adapted to fit closely within the bottle neck BN whereby their free ends may be inserted between the cork and the bottle neck as the handle is forced axially toward the bottle neck and rotated in one directional sense. In this case, the handle 32 has no shoulder which is intended to engage the upper end of the bottle, and instead it is contemplated that, due to the length of the helical springs, the cork may begin to rotate within the bottle neck before the entire length of the springs is inserted. However, if the cork does not begin to rotate, the handle may be held by the user against axial movement with respect to the bottle neck and while it continues to be rotated in one directional sense, so that, and as illustrated by FIGS. 7 and 8, continuing rotation of the handle will draw the cork upwardly from the bottle neck and into the helical springs above it. This, together with the reduced frictional surfaces between the cork and bottle due to insertion of the helical springs, will free the cork for rotation with respect to the bottle, whereby the application of an axially outward pull on the handle will remove the cork along with the helical springs from the neck of the bottle. Here again, the axial pull on the helical springs will increase their pitches and thus reduce their diameters so as to apply further squeeze on the cork to facilitate its removal from the bottle neck.

As shown at 33 in FIG. 6, as well as in FIG. 5, the free end of each helical coil 31 is beveled to provide a thin edge adjacent its outer diameter which facilitates its insertion between the cork and bottle neck. In this respect, as in the previously described embodiment, the free ends of all three helical springs are on the same axial level so that each begins to penetrate between the cork and bottle neck at the same time.

The device constructed in accordance with the embodiment of the invention illustrated in FIGS. 9 to 11, and indicated in its entirety by reference character 40, comprises only a single helical coil 41 and a handle 42 which comprises an extension of one end of the helical spring. More particularly, the helical spring is bent outwardly at 43 and then back inwardly to form a handpiece which, as shown in FIGS. 9 and 10, extends above and diametrically across the axis of the helical spring. This, of course, results in a device which is of extremely simple construction and thus which is inexpensive to manufacture.

The device 40 could be used in the same manner as the device 20 of FIGS. 1 to 4 inasmuch as the intersection of the bent portion 43 of the lateral extension of the helical spring with the one end of the helical coil provides a shoulder adapted to engage the upper end of the bottle neck upon insertion of the full length of the helical spring between the cork and bottle. Thus, as described in connection with the device 20, the spring 41 may not be long enough to remove a sufficient portion of the outer surface of the cork from engagement with the inner surface of the bottle neck to free the cork for rotation with respect to the bottle neck. Thus, the handle and thus the helical spring could continue to be rotated so as to cause the cork to be screwed partially out of the bottle neck, as described in connection with the device 20, until such time that the surface between the cork and the bottle neck has been further reduced to permit its removal by means of an axial pull on the handle 42.

As shown at 46 in FIG. 9, the free end of the single helical coil is beveled to provide a thin edge adjacent its outer diameter which facilitates its removal of the cork. In this embodiment, the free end of the helical coil is also shown to taper toward its upper and lower edges.

The embodiment of the device shown in FIGS. 12 to 14, and indicated in its entirety by reference character 50, differs from the device 40 of FIGS. 8 to 10 in that it comprises a pair of helical springs 51, but is similar thereto in that the handle 52 comprises bent portions extending from the ends of the springs, thereby also providing a device of very simple construction and thus one which is inexpensive to manufacture. As in the other embodiment of the invention having two helical springs, the identical springs are arranged concentrically with one another and 180° out of phase. Furthermore, their free ends are beveled at 53 to form thin edges adjacent their outer diameters to facilitate insertion of the helical springs between the cork and the neck of the bottle.

The lateral extension of each helical spring forming the handle 52 includes an outwardly bent portion 54 and a reversely bent portion 55 which, as shown in FIG. 13, extend diametrically opposite to portions of the other and with bent portions 55 adjacent to one another to provide a sturdy grip above and across the ends of the helical springs. In this case as well, the intersection of each outwardly bent portion 54 and the adjacent end of the helical spring forms a shoulder 56 which may engage the end of the bottle neck. Thus, the device 50 may be used in the manner described in connection with one or more of the other devices.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A device for use in removing a cork or other resilient stopper from the neck of a bottle, comprising helical spring means including at least one helical spring adapted to fit closely within the bottle neck and having a handle at one end by which the spring means may be rotated in one directional sense, as it is inserted and forced axially inwardly between the cork and neck, and then pulled axially outwardly, so as to remove the cork and spring means from the neck, said cork being removable from the spring means upon rotation of the handle in the opposite directional sense with respect to the cork.

2. A device of the character defined in claim 1, wherein the free end of each spring is beveled to provide a thin edge adjacent its outer diameter which facilitates its insertion between the cork and neck.

3. A device of the character defined in claim 1, wherein the handle has a shoulder engageable with the bottle neck to limit the extent to which the spring means may be inserted between the cork and neck of the bottle, whereby further rotation of the handle begins to withdraw the cork axially outwardly from the bottle neck and into a space within the spring means above it.

4. A device of the character defined in claim 1, wherein the handle comprises an extension of one end of each helical spring of the spring means which is bent outwardly and then inwardly and diametrically across and spaced from such one end of the helical spring.

5. A device of the character defined in claim 4, wherein there are a pair of helical springs, and the inwardly bent portions of the extensions of the springs are disposed adjacent one other.

6. A device of the character defined in claim 1, wherein the handle comprises a laterally extending hand piece which is anchored to and encloses the spring means adjacent its one end.

7. A device of the character defined in claim 1, wherein the spring means consists of a single helical spring.

8. A device of the character defined in claim 1, wherein the spring means comprises a plurality of helical springs each of the same outer diameter and wound in the same helical direction.

* * * * *